United States Patent [19]

Morton

[11] Patent Number: 5,021,087

[45] Date of Patent: Jun. 4, 1991

[54] PROCESS AND APPARATUS FOR TREATING MOLTEN ALUMINUM TO ADD HYDROGEN GAS

[76] Inventor: Douglas H. Morton, 1520 Pleasant Ridge Ave., Minerva, Ohio 44657

[21] Appl. No.: 566,151

[22] Filed: Aug. 13, 1990

[51] Int. Cl.[5] ..... C22B 9/00

[52] U.S. Cl. ..... 75/678

[58] Field of Search ..... 75/678

[56] References Cited

U.S. PATENT DOCUMENTS 3,159,478 12/1964 Gottschalk ..... 75/680

*Primary Examiner*—Peter D. Rosenberg

*Attorney, Agent, or Firm*—Edward J. Holler

[57] ABSTRACT

This invention relates to a process and apparatus for treating molten aluminum prior to casting by adding a hydrogen-containing treating gas to the atmosphere over the molten aluminum during melting. A preferred treating gas is finely-atomized water vapor which is added to the fuel-air mixture to be delivered to burners to obtain a disassociation of water vapor into hydrogen and oxygen. The added hydrogen satisfies the affinity of molten aluminum for hydrogen, the addition being controlled to near the saturation point temperature of hydrogen within the molten aluminum. Improved casting properties are obtained in the molded parts which have smaller grain refinement and greater dispersion of shrinkage on cooling to solidification. The treating gas may also consist of hydrogen gas or ammonia gas, the hydrogen being supplied over the molter aluminum when heated to a temperature ranging from about 1200° F. to 1480° F.

20 Claims, 1 Drawing Sheet

PROCESS AND APPARATUS FOR TREATING MOLTEN ALUMINUM TO ADD HYDROGEN GAS

BACKGROUND OF THE INVENTION

1. Technical Field

The present invention relates to a process and apparatus for treating molten aluminum to add hydrogen gas to satisfy the affinity of molten aluminum for hydrogen and to improve its casting properties.

2. Background Information

The term "aluminum" as used in the subject application includes pure aluminum metal and all aluminum alloys whether or not aluminum constitutes the major constituent of such metal alloys.

Molten aluminum prior to casting contains dissolved hydrogen gas in widely varying amounts along with other non-metallic inclusions such as aluminum oxide and magnesium oxide which are normally considered undesirable impurities. It has been considered that hydrogen gas, when present in molten aluminum, may produce defects in ingots prepared from the melt and also in products manufactured from such ingots. It is heretofore been thought that hydrogen gas must be removed from the molten metal along with non-metallic inclusions in the manufacture of high-quality aluminum products.

In the prior art, hydrogen gas and non-metallic inclusions are frequently removed from molten aluminum by introducing an inert gas into the molten metal in the form of bubbles. Normally, since the atmosphere over the molten aluminum contains some water, it has been thought that the water in the atmosphere over the surface of the molten aluminum metal presents problems when the hydrogen from the disassociated water penetrates into the melt. The surface of molten aluminum which is usually quiescent during the melting is normally covered with a thin aluminum oxide coating or layer so that the water in the overlying atmosphere does not normally react with aluminum. However, when a treating gas such as an inert gas or chlorine gas is forced into the molten aluminum, the bubbles released to float on the surface of the melt break up the surface layer and the overlying aluminum oxide coating exposing the melt to the atmosphere at the broken surface areas. The water in the atmosphere then reacts with aluminum before the oxide coating is allowed to reform, hydrogen gas being produced from disassociation of the water and then penetrating into the melt in an uncontrolled fashion.

Processes have been proposed in which the enclosed treating vessel for containing molten aluminum is filled above the surface of the molten aluminum with a treating gas at a higher pressure than atmospheric pressure such as disclosed in U.S. Pat. No. 3,870,511.

The process disclosed therein requires a large volume of inert treating gas involving a relatively costly treating process. Another process for removing hydrogen gas and non-metallic inclusions from molten aluminum is disclosed in U.S. Pat. No. 4,772,319 wherein the water content of the atmosphere above the surface of the molten aluminum is reduced in atmospheric pressure to decrease the amount of hydrogen gas resulting from the reaction between the molten aluminum and the water, the reduced atmospheric pressure achieving hydrogen gas removal from the melt. The atmosphere of the air overlying the melt has a lower dew point than that of the normal atmosphere, inert treating gas being required for hydrogen gas elimination. Such process is not particularly useful in a continuous melting process, however, when raw aluminum ingots are fed continuously or intermittently into the receiving end of a melting furnace and molten aluminum is essentially continuously withdrawn in near equal amounts for casting operations. Maintaining the reduced atmospheric pressure within the furnace requires a costly air-tight furnace construction and air locks difficult to maintain and expensive inert gases to control such melting processes.

U.S. Pat. No. 4,521,001 discloses an apparatus for removing gases from molten aluminum, the furnace being provided with a removable specially-designed cover to maintain a partial vacuum between the cover and the molten metal surface which process is inapplicable to a continuous melting furnace wherein large quantities of molten aluminum are required for essentially continuous casting operations. Such furnaces are normally capable of melting large volumes of molten aluminum such as 20 tons in the manufacture of large automotive engine parts.

Virtually all of the prior art involves the removal of uncontrolled hydrogen gas from the molten aluminum to obtain desired casting properties in the resultant cast articles. None of such art involves the positive introduction of a controlled near saturation level of hydrogen gas into the molten aluminum to obtain improved casting properties in the manufacture of large automotive parts, for example.

SUMMARY OF THE INVENTION

An object of the present invention is to provide a process and apparatus for the addition of hydrogen gas to molten aluminum by introducing a hydrogen-containing treating gas into the molten aluminum wherein the treating gas is included in the atmosphere over the molten aluminum during its melting process, the amount of included hydrogen gas being carefully maintained and controlled during the melting operation to obtain improved cooling and solidification of cast aluminum parts, especially those having relatively large sizes such as automotive engine manifolds and the like. The treating gas in the subject invention includes a hydrogen-containing economical treating gas which will readily react with the molten aluminum to achieve the result of improved hydrogen gas introduction into the molten metal at a controlled rate to increase the proliferation of nucleation sites for improved grain refinement of cast metal parts on cooling having greater dispersion of shrinkage and improved dimensional characteristics. Introduction of hydrogen into the overlying atmosphere and into the melt satisfies the affinity of molten aluminum for hydrogen and permits improved casting of large size parts.

Another object of the present invention is to provide a process and apparatus which does not involve the requirement of using an expensive inert gas to obtain the removal of hydrogen gas from the molten melt during the melting process, but, conversely, provides for the addition of a controlled amount of hydrogen-containing treating gas into the melt to obtain substantially improved physical properties in cast parts.

The process of this invention for treating molten aluminum is to add a controlled amount of hydrogen gas to the molten aluminum during the melting process to near its saturation point level wherein a hydrogen-containing treating gas such as water vapor is added to the atmosphere above the bath of molten aluminum either intermittently or continuously to maintain the controlled level of hydrogen gas inclusion in the melt to obtain improved properties in cast parts, especially those of large sizes requiring relatively long cooling and solidification periods. The amount of water vapor is carefully controlled during melting such as by its inclusion in the mixture of a combustible fuel and air employed to melt the aluminum to selectively and controllably enhance the affinity of molten aluminum for hydrogen gas.

According to the subject process the water content in the atmosphere above the surface of the molten aluminum contained in the treating and melting furnace is increased substantially to assist the hydrogen component of the water in reacting with the molten aluminum whereby the amount of hydrogen gas resulting from the reaction is increased to achieve improved hydrogen gas addition efficiency by relatively inexpensive and simplified process steps.

In the manufacture of certain highly-technical scientific aluminum parts or components for scientific instruments, it may be necessary to eliminate the hydrogen component from the aluminum essentially completely. However, in the manufacture of large size parts such as used in automotive and truck engines for weight reduction, the hydrogen content of the aluminum is a desirable requirement for component parts having improved physical and chemical properties for their intended purpose.

Treating gases which are particularly useful for introduction of hydrogen into the molten aluminum are those which are particularly economical and commonly available such as water vapor, hydrogen gas and ammonia, each of which is capable of supplying the hydrogen requirement into the molten aluminum upon disassociation of the added gas to release hydrogen gas over the surface of the molten aluminum. The hydrogen diffuses within the molten aluminum upon breakdown of the selected treating gas, the hydrogen moving into and diffusing uniformly throughout the aluminum basically due to its commonly known reaction with the molten aluminum for their combining at elevated temperatures. The non-metallic inclusions in the molten aluminum are normally formed in the dross layer over the molten metal surface, the hydrogen-containing treating gas being included in the aluminum normally at a saturation level which is particularly useful in controlling and promoting the formation of additional nucleation sites in the metal and dispersion of shrinkage throughout the body of large cast parts upon cooling.

BRIEF DESCRIPTION OF THE DRAWINGS

The preferred embodiment of the invention illustrative of the best mode in which the applicant has contemplated applying the principles, is set forth in the following description and is shown in the drawings, and are particularly and distinctly pointed out and set forth in the appended claims.

Similar numerals refer to similar parts throughout the drawings.

DESCRIPTION OF THE PREFERRED EMBODIMENT

Figure 2:
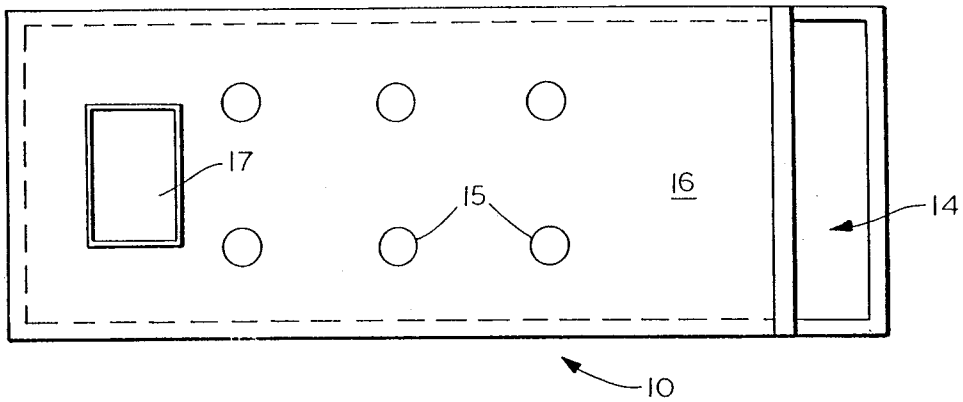
FIG. 2 is a top plan view of the melting furnace shown in FIG. 1.
Figure 1:
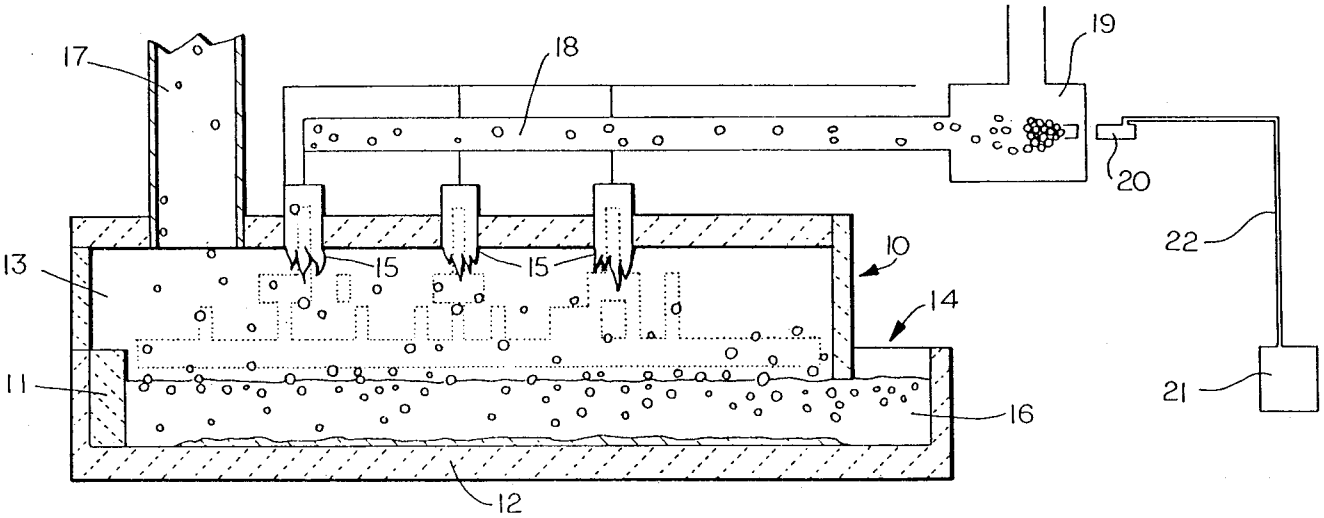
FIG. 1 is a cross-sectional view of a melting furnace for melting aluminum and its alloys into molten condition for casting preferably on a continuous basis.

Referring now to the drawings in detail, the melting furnace 10 comprises a containment vessel or tank formed of ceramic material which is placed around the walls of the furnace in such a manner that the melt is surrounded on all sides by the furnace walls 11 and furnace bottom 12. The furnace construction is normally one which is formed with steel shell exterior (not shown) having a lining of high-temperature-resistant ceramic material to withstand long-term melting of aluminum and its alloys. Such furnaces are well known in the aluminum foundry art and may be varied widely. The aluminum is supplied to the furnace normally in the form of ingots (not shown) which are fed into the inlet end 13 of the furnace 10 and the molten aluminum in liquid form is withdrawn from the outlet end 14 of the furnace for casting into aluminum parts by casting processes which are well-known in the art. The aluminum melt 16 within the furnace may be heated into molten form either by a plurality of burners 15 projecting downwardly over the metal melt, the burners being mounted in spaced-apart aligned relation to burn a combustible fuel-air mixture. The products of combustion are removed from the furnace through an exhaust duct 17 leading to a stack.

A preferred type of furnace for practicing the present process is one which is capable of essentially continuously melting molten aluminum by adding aluminum ingots into the inlet end of the furnace and withdrawing essentially equivalent amounts of molten aluminum for casting, the treated molten aluminum having improved properties after being subjected to the present process.

The furnace 10 is preferably heated by a combustible fuel-air mixture such as natural gas and air delivered to the plurality of burners 15 extending downwardly over the molten aluminum bath, the burners normally comprising from 6 to 8 in number being supplied by an inlet line 18 located exteriorly over the furnace. The treating gas is introduced into the combustible fuel-air mixture exteriorly of the furnace. Water vapor in finely atomized form is a preferred treating gas which is introduced in such form into the fuel-air mixture for its discharge into the atmosphere over the molten metal bath. An atomizer 20 is preferably located near the furnace connected to a distilled water source 21 and the water inlet line 22 to atomize the water into extremely fine droplets ranging in size from about 35 to 100 microns for delivery into the combustible fuel and air mixing chamber 19. The treating gas may also consist of hydrogen gas or ammonia gas which may be similarly introduced into the combustible mixture. Obviously, in view of the combustible nature of the hydrogen gas, and its being a costly constituent, water vapor which is non-combustible will dissociate into oxygen and hydrogen gases on high-temperature heating being the preferred hydrogen-containing treating gas. The water vapor, for example, may be introduced intermittently or continuously into chamber 19 and line 18 to maintain a prescribed level of hydrogen gas over the molten aluminum for its absorption and reaction therewithin; such absorption being readily achieved due to the extremely high affinity of molten aluminum to react with hydrogen gas.

The furnace may also be electrically heated to melt the aluminum such as by a plurality of electrical-resistant heating elements disposed within the molten melt bath. In such case the treating gas is introduced into the atmosphere over the melt and in the case of water vapor it may be disassociated by one or more burners as aforesaid to generate the hydrogen for addition.

The treating gas is applied to obtain a hydrogen gas content in the molten aluminum ranging from about 0.04 cubic centimeters of hydrogen gas per 100 grams of aluminum to an essentially saturation level of about 1.70 cubic centimeters of hydrogen gas per 100 grams of aluminum. When the molten aluminum is in molten form at a temperature of 1220° F. the aluminum is capable of retaining 0.69 cubic centimeters of hydrogen gas per 100 grams of aluminum, this level being essentially the saturation point temperature of hydrogen within the molten aluminum. When the temperature of the molten aluminum is of the order of 1562° F., the solubility of the hydrogen in molten aluminum is of the order of 2.15 cubic centimeters of hydrogen gas per 100 grams of aluminum which is essentially the saturation point temperature. The aluminum is normally melted in the furnace at a temperature ranging from about 1200° F. to 1480° F. in many cases for casting, depending upon the selected casting method.

Depending upon the amounts of molten aluminum which are withdrawn from the melting furnace, the treating gas is preferably applied intermittently to maintain the hydrogen gas level in the aluminum within the aforesaid ranges. Determinations of the hydrogen gas saturation within the aluminum is measured periodically to insure that the aluminum is treated to positively contain the hydrogen gas within the prescribed level essentially to near saturation. When the treating gas is applied intermittently to the molten aluminum contained within a twenty ton furnace, for example, when 1000 pounds of molten aluminum is removed in a molten state for casting, normally an equivalent replacement amount of 1000 pounds of raw ingots is added to the molten aluminum at the inlet side of the furnace. Such amounts may be considered somewhat typical of commercial melting of aluminum in the manufacture of large automotive engine parts. The water vapor introduced into the fuel-air mixture during melting may be delivered for one second and turned off for 9 seconds, which results in the treating gas addition being maintained on for about 10 percent of the melting time. The volume of treating gas is regulated depending upon the amount of molten metal requirement for casting operations. In another typical example the water vapor addition may be on for 5 seconds within a 55 second period with an 8 percent injection interval of the total melting time.

The addition of the hydrogen gas to the molten aluminum offers distinct advantages in dispersion of shrinkage of the cast parts during the cooling period. The hydrogen provides a greater proliferation of nucleation sites in the aluminum during the beginning of solidification on cooling of the molten metal. Such nucleation results in small grain refinement and improved shrinkage of the cooled part. The shrinkage is dispersed more uniformly than that experienced without the hydrogen treating process. The part normally cools in layers or zones and frequently loses as much of 3 percent of its volume on cooling to solidification which must be allowed for in the manufacture of precision parts. The added hydrogen creates a substantially greater number of sites of nucleation which promote smaller grain refinement. The hydrogen makes available such sites which are dispersed at very finely distributed nucleation points for improved grain refinement and increased quality of parts of precise shape and dimensions. The process provides a clean and efficient method of adding hydrogen to aluminum and its alloys for the purpose of shrink dispersion through a greater volume of the cast parts. It also promotes grain refinement and a unique modification of the eutectic properties of the cast parts.

The process is particularly applicable to various forms of aluminum casting such as those known as land casting, permanent mold die casting, antifigural casting, and low-pressure permanent molding. In all such processes the hydrogen addition is particularly useful to produce a greater dispersion of shrinkage in the cast parts and greater dimensional stability.

Accordingly, the improved process and apparatus are simplified, provide an effective, safe, inexpensive, and efficient method and device which achieves all the enumerated objectives, provide for eliminating difficulties encountered with prior devices, and solves problems and obtains new results in the art.

In the foregoing description, certain terms have been used for brevity, clearness and understanding; but no unnecessary limitation are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved process and apparatus is constructed and used, the characteristic of the construction, and the advantageous, new and useful results obtained; the new and useful structure, devices, elements, arrangements, parts and combination, are set forth in the appended claims.

I claim:

1. The process of melting aluminum into molten form for casting to satisfy the affinity of molten aluminum for hydrogen and to improve its casting properties, said process comprising the steps of heating the aluminum into molten form within an enclosed melting furnace, introducing a hydrogen-containing treating gas into the atmosphere above the molten aluminum, the amount of treating gas ranging in amount from about 0.04 cubic centimeters of hydrogen gas per 100 grams of aluminum to the saturation point temperature of said treating gas in said molten aluminum.

2. The process in accordance with claim 1, wherein the said hydrogen-containing treating gas is selected from the group consisting of water vapor, hydrogen and ammonia.

3. The process in accordance with claim 1, wherein the temperature of the molten aluminum ranges from about 1200° F. to 1480° F. and the treating gas is introduced intermittently to maintain a prescribed controlled saturation level of hydrogen gas in said aluminum.

4. The process in accordance with claim 1, wherein the said treating gas consists of finely atomized water vapor.

5. The process in accordance with claim 1, wherein the said treating gas is introduced intermittently into the atmosphere over the molten aluminum to maintain a prescribed hydrogen saturation level in the metal melt during a continuous melting process prior to casting.

6. The process in accordance with claim 1, wherein the said treating gas consists of finely-atomized water vapor ranging in amount of hydrogen within the metal melt from about 0.04 to 1.70 cubic centimeters of hydrogen gas per 100 grams of aluminum.

7. The process in accordance with claim 1, including the step of injecting finely-atomized water vapor into the combustible fuel-air mixture over the molten aluminum during the melting operation.

8. The process of melting aluminum into molten form for casting to satisfy the affinity of molten aluminum for hydrogen and to improve its casting properties, said process comprising the steps of heating the aluminum in an enclosed melting furnace with a combustible fuel-air mixture supplied to burners mounted within said furnace, introducing water vapor in finely-atomized form into the atmosphere above the molten aluminum, said molten aluminum ranging in temperature from about 1200° F. to 1480° F., said water vapor being introduced intermittently in an amount to provide a prescribed level of hydrogen in the melt ranging from about 0.04 to 1.70 cubic centimeters of hydrogen gas per 100 grams of aluminum during a continuous melting process prior to casting.

9. The process in accordance with claim 8, including the step of introducing the said water vapor in combination with the said combustible fuel-air mixture delivered to said burners for its dissociation with the products of combustion and inclusion of hydrogen in a controlled amount in the atmosphere over the metal melt.

10. The process in accordance with claim 8, wherein the said water vapor is introduced into the combustible fuel-air mixture above the molten aluminum to supply hydrogen during essentially the term of the melting operation.

11. The process in accordance with claim 8, wherein the said water vapor is stripped of its hydrogen at the surface of the molten aluminum to retain an essentially uniformly controlled amount of hydrogen gas in said metal melt at the elevated melting temperature.

12. The process in accordance with claim 8, including the step of casting the molten aluminum into a shaped article to obtain greater dispersion of shrinkage over the entire volume of the said shaped article on cooling.

13. The process of melting an aluminum-containing metal into molten form for casting to satisfy the affinity of molten aluminum for hydrogen and to improve its casting properties, said process comprising the steps of heating the molten aluminum metal contained in an enclosed melting furnace by a combustible fuel-air mixture, introducing water vapor in finely-atomized form into the said fuel-air mixture prior to combustion within the atmosphere over the contained molten aluminum, and maintaining the introduction of the said water vapor at a uniformly controlled level throughout the duration of a continuous melting operation to provide a prescribed hydrogen gas level in the metal melt prior to casting.

14. The process in accordance with claim 13, wherein the said molten aluminum-containing metal is heated to a temperature ranging from about 1200° F. to 1480° F. within the said melting furnace.

15. The process in accordance with claim 13, wherein the said water vapor introduced into the said furnace along with the fuel-air mixture produces hydrogen gas in a controlled amount in the aluminum ranging in amount from about 0.04 to 1.70 cubic centimeters of hydrogen gas per 100 grams of aluminum.

16. The process in accordance with claim 13, including the step of casting the molten aluminum-containing metal into a shaped article having a greater number of nucleation sites for improved grain refinement with greater dispersion of shrinkage of said article.

17. Combined apparatus for melting aluminum into molten form for casting into shaped articles to satisfy the affinity of molten aluminum for hydrogen and to improve its casting properties, said apparatus comprising an enclosed melting furnace for melting aluminum on an essentially continuous basis, heating means disposed within said furnace for heating the said aluminum into molten condition, and means for introducing a hydrogen-containing treating gas into the atmosphere over the said molten aluminum during the melting process to control the hydrogen gas saturation level within said molten aluminum prior to casting.

18. Combined apparatus in accordance with claim 17, wherein the said heating means comprises a plurality of combustible fuel-air burners mounted within said melting furnace, and means for intermittently introducing water vapor into the atmosphere in a uniformly controlled amount over the said molten aluminum during melting.

19. Combined apparatus in accordance with claim 17, wherein the said means for introducing a hydrogen-containing treating gas comprises at least one atomizer for finely-atomizing water vapor from a water source and at least one inlet line for delivering said finely-atomized water vapor to said burners and the atmosphere above the molten aluminum for supplying hydrogen gas to said metal melt.

20. The process for treating molten aluminum during its continuous melting into molten form for casting to satisfy its affinity for hydrogen and to improve its casting properties, said process comprising the steps of melting the aluminum in an enclosed melting furnace, introducing a controlled amount of a hydrogen-containing treating gas into the atmosphere over the molten aluminum, the treating gas being selected from the group consisting of water vapor, hydrogen gas and ammonia, controlling the amount of treating gas introduced into said atmosphere above the molten aluminum to produce hydrogen gas in the melt ranging from about 0.04 to 1.70 cubic centimeters of hydrogen gas per 100 grams of aluminum, and casting the said molten aluminum into a shaped article to obtain the promotion of nucleation sites for grain refinement and greater dispersion of shrinkage of said article on cooling.

* * * * *